US011384613B1

(12) United States Patent
Gao et al.

(10) Patent No.: US 11,384,613 B1
(45) Date of Patent: Jul. 12, 2022

(54) WELLBORE DART WITH SEPARABLE AND EXPANDABLE TOOL ACTIVATOR

(71) Applicant: Halliburton Energy Services, Inc., Houston, TX (US)

(72) Inventors: Bo Gao, Houston, TX (US); Lonnie Carl Helms, Houston, TX (US); Aniruddha Gadre, Houston, TX (US); Yuzhu Hu, Houston, TX (US); Gary J Makowiecki, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/214,878

(22) Filed: Mar. 28, 2021

(51) Int. Cl.
*E21B 23/08* (2006.01)
*E21B 34/14* (2006.01)

(52) U.S. Cl.
CPC ..... *E21B 23/08* (2013.01); *E21B 34/14* (2013.01)

(58) Field of Classification Search
CPC ..... E21B 23/08; E21B 34/14; E21B 23/0413; E21B 34/142
See application file for complete search history.

(56) References Cited

U.S. PATENT DOCUMENTS 3,263,752 A * 8/1966 Conrad ..... E21B 34/14 166/318
7,387,165 B2 * 6/2008 Lopez de Cardenas ..... E21B 43/14 166/313
8,276,674 B2 * 10/2012 Lopez de Cardenas ..... E21B 43/08 166/334.4
9,394,752 B2 * 7/2016 Fleming ..... E21B 23/006
9,683,419 B2 * 6/2017 Coon ..... E21B 43/14
10,125,573 B2 * 11/2018 Flores Perez ..... E21B 33/14
10,132,139 B1 11/2018 Roberts et al.
10,370,917 B2 * 8/2019 Coon ..... E21B 43/14
10,494,892 B2 12/2019 Makowiecki et al.
2011/0284240 A1 * 11/2011 Chen ..... E21B 34/14 166/334.1
2013/0153220 A1 6/2013 Carter et al.
2015/0000935 A1 * 1/2015 Pabon ..... E21B 34/14 166/386
2015/0167428 A1 6/2015 Holfman et al.
2016/0362957 A1 * 12/2016 Barbato ..... E21B 34/14
2019/0234174 A1 * 8/2019 Crow ..... E21B 34/14
2021/0277741 A1 * 9/2021 Xue ..... E21B 33/134

FOREIGN PATENT DOCUMENTS

CN 204312022 U 5/2015

* cited by examiner

*Primary Examiner* — Michael R Wills, III
(74) *Attorney, Agent, or Firm* — Sheri Higgins Law, PLLC; Sherri Higgins

(57) ABSTRACT

A wellbore dart can be used to activate a downhole tool within a wellbore to perform a function, such as shifting a sleeve. The dart includes a tool activator that is releasably connected to a body of the dart. After the downhole tool has been activated, the body can be released from the tool activator to open a fluid flow path within the downhole tool. A device can be pumped and land on the tool activator. The tool activator can include multiple sections that expand radially away from each other when force from the device is exerted on the sections. Expansion of the sections allows the device to pass through the tool activator. The dart can also include a retracting device that moves the sections back together after the device has passed through the tool activator.

20 Claims, 6 Drawing Sheets

WELLBORE DART WITH SEPARABLE AND EXPANDABLE TOOL ACTIVATOR

TECHNICAL FIELD

A wellbore dart and methods of use are provided. The wellbore dart includes a tool activator that is used to activate a component of a downhole tool. The tool activator is separable from the other components of the dart.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION OF THE INVENTION

Figure 1:
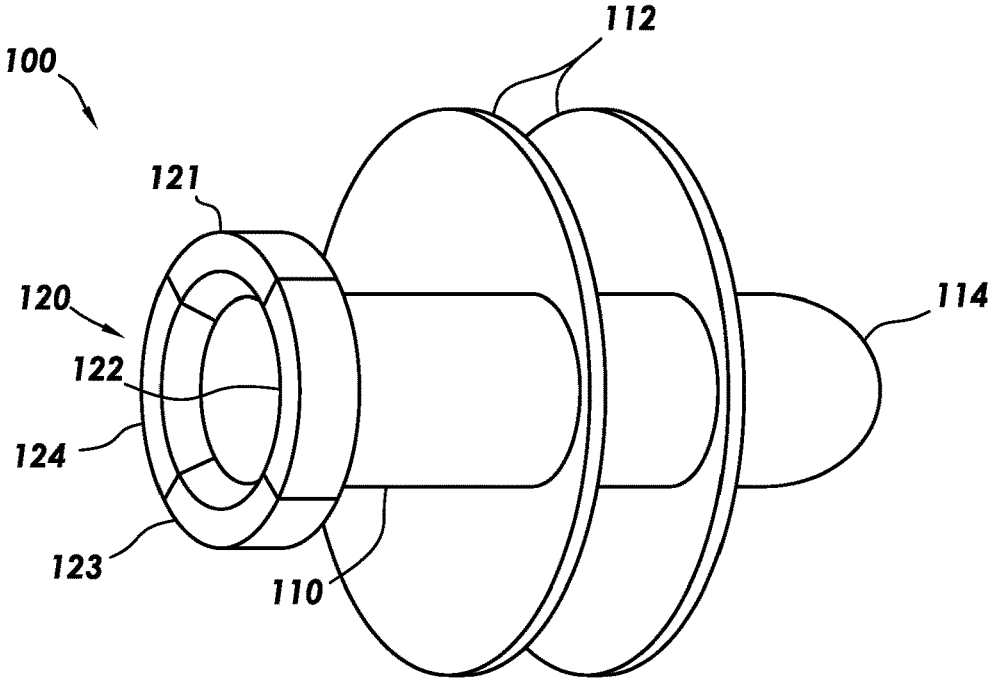
FIG. 1 is a perspective view of a wellbore dart according to certain embodiments.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A portion of a wellbore can be an open hole or a cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

Wellbore treatment operations can be performed in a wellbore. Treatment operations can involve placing a downhole tool at a desired location within the wellbore. The downhole tool can be used to perform a wide variety of treatment operations. A wellbore dart can be used to activate a component of a downhole tool, such as to shift a sleeve, rotate a sleeve, or block fluid flow through the tool. The wellbore dart can also be used to separate fluids within the wellbore.

Darts are generally composed of a body, a nose, a tool activator, and optionally one or more wiper fins (also referred to in the industry as wiper cups). The dart is pumped into the wellbore where the tool activator engages with a downhole tool and activates a component of the downhole tool. The nose can help guide the dart through a tubing string and can be weighted to assist vertical alignment of the dart within the tubing string. The nose can also seat against a component of the downhole tool to block fluid flow through the downhole tool. Wiper fins can also be included on the dart. The wiper fins can be located circumferentially around the outside of the dart body and can function to "wipe" the inside of the tubing string and separate fluids as the dart is being pumped into the wellbore.

One significant disadvantage to traditional darts is that the dart used to activate one downhole tool can block placement of other devices, such as darts or balls, below the dart because the body of the dart obstructs the inside of the downhole tool. In order to allow placement of other darts or balls below the dart, the dart must be removed from the wellbore. Removal of the dart can include drilling the dart or running a retrieval tool into the wellbore to pull the dart out of the wellbore. The process of removing the dart is not only time consuming, but also increases the cost of performing the wellbore operation. As such, there is a need and ongoing industry concern for improved darts that activate a downhole tool.

Novel darts are disclosed. The dart includes a tool activator that is separable from the body of the dart after the dart has activated a downhole tool. The dart can be used to activate a downhole tool. One of the many advantages of the novel dart is that the body of the dart does not prevent additional devices, such as darts or balls, from being introduced into the wellbore downstream of the dart after separation from the tool activator. Thus, the dart does not have to be removed from the wellbore in order for tools to be subsequently activated or balls to seat on a ball seat.

A wellbore dart can include: a body; and a tool activator releasably connected to the body by a frangible device, wherein the tool activator comprises: a first section; a second section; and a third section, wherein the first, second, and third sections are movable radially away from each other into an expanded position when a force is applied to an inner diameter of the tool activator.

The wellbore dart can further include a retracting device, wherein the retracting device is configured to move the first, second, and third sections radially towards each other from the expanded position into a retracted position when the force is removed from the inner diameter of the tool activator.

Methods of activating a downhole tool can include: introducing a dart into a wellbore, wherein the dart comprises: a body; and a tool activator comprising a first section; a second section; and a third section, wherein the tool activator is releasably connected to the body by a frangible device; causing or allowing the tool activator to activate the downhole tool; releasing the tool activator from connection with the body; introducing a device into the wellbore, wherein the device has an outer diameter that is greater than an inner diameter of the tool activator; causing the device to pass through the tool activator, wherein the device causes the first, second, and third sections to move radially away from each other into an expanded position as the device passes through the tool activator; and allowing the first, second, and third sections to move radially towards each other into a retracted position after the device has passed through the tool activator.

It is to be understood that the discussion of any of the embodiments regarding the dart or any component of the dart is intended to apply to all of the method and apparatus embodiments without the need to repeat the various embodiments throughout.

Turning to the Figures, FIG. 1 is a perspective view of a wellbore dart 100. The dart 100 can include a body 110. The body 110 can be cylindrical in shape and have a variety of dimensions. The length of the body 110 can be selected such that a desired orientation of the dart 100 within a tubing string during introduction into a wellbore is achieved. The desired orientation can be a substantially centered longitudinal axis of the body 110 within the inside of the tubing string. In this manner, the dart 100 can maintain a substantially axial orientation within the tubing string and does not tilt off its longitudinal axis. The length of the body 110, for example, can range from 10 inches (in.) to 30 in.

The outer diameter (O.D.) of the body 110 can vary and can be selected such that the dart 100 is capable of being placed in a desired location within the wellbore. Accordingly, the O.D. of the body 110 can be less than the inner diameter (ID.) of any tubing string or downhole tool that the dart 100 is meant to pass through. The O.D. of the body 110 can also be selected such that the desired orientation of the dart 100 within the tubing string during introduction into the wellbore is achieved. The O.D. of the body 110, for example, can range from ½ in. to 4 in.

The body 110 can be made from materials known to those skilled in the art. Non-limiting examples of materials include metals, metal alloys, and hardened plastics, such as thermoset and thermoplastic materials. According to any of the embodiments, the body 110 is solid. According to any of the embodiments, the body can include a hollow core. According to any of the embodiments, the body 110 does not include a rupture disk. Any common bodies known to those skilled in the art can be used for the dart 100. The body can be sized such that wipers 112 can fold up in the annular space between the O.D. of the body 110 and an I.D. of the casing or tubing through which the wellbore dart 100 passes.

The dart 100 can also include a nose 114. The nose 114 can be located at a first end of the body 110. The nose 114 can function as a guide for the dart 100 during introduction into the wellbore. A variety of noses known to those skilled in the art can be used for the dart 100. The nose 114 can, for example, be rounded or weighted, and/or form a high-pressure seal when seated onto or within a downhole tool. The nose 114 can include a latch ring or lock ring that can secure the dart 100 in place after landing on a seat.

The dart 100 can also include one or more wipers 112 (also known as wiper fins or wiper cups). The wipers 112 can function to separate two different wellbore fluids and "wipe" or remove residual fluid on the inside of a tubing string. Although shown with two wipers 112 in the drawings, it is to be understood that a plurality of wipers 112 can be included on the dart 100. The wipers 112 can extend circumferentially around the outside of the body 110. The O.D. of the wipers 112 can be the same or different. Different sized wipers can be used to wipe different sized tubing strings. The wipers 112 can be made of commonly known materials, for example, natural or synthetic rubber or urethane elastomers that provide flexibility to the wipers. A variety of wipers 112 known to those skilled in the art can be used for the dart 100. The geometric shape of the wipers 112 can vary. The angle at which the wipers 112 extend away from the body 110 towards the I.D. of the tubing or casing string can also vary and be selected such that the wipers engage in a wiping action on the inside of the tubing or casing string. The thickness of the wipers 112 can also vary. The shape, angle, thickness, and total number of wipers 112 can be selected to provide multiple external steps or compound angles targeted at multiple inner diameters the dart 100 must pass through. In this manner, the wipers 112 can engage with a variety of different inner diameters and function to wipe the inside of different sized tubing or casing strings.

The dart 100 also includes a tool activator 120. Still with reference to FIG. 1, the tool activator 120 can include a first section 121, a second section 122, and a third section 123. The tool activator 120 can also include a fourth section 124, a fifth, sixth, seventh, and so on sections (not shown). As will be discussed in more detail below, the tool activator 120 preferably includes at least three sections. The tool activator 120 can be made from a variety of materials including, but not limited to, metals, metal alloys, and hardened plastics or composites. Metals and metal alloys can be selected from aluminum, steel, or cast iron.

Figure 2:
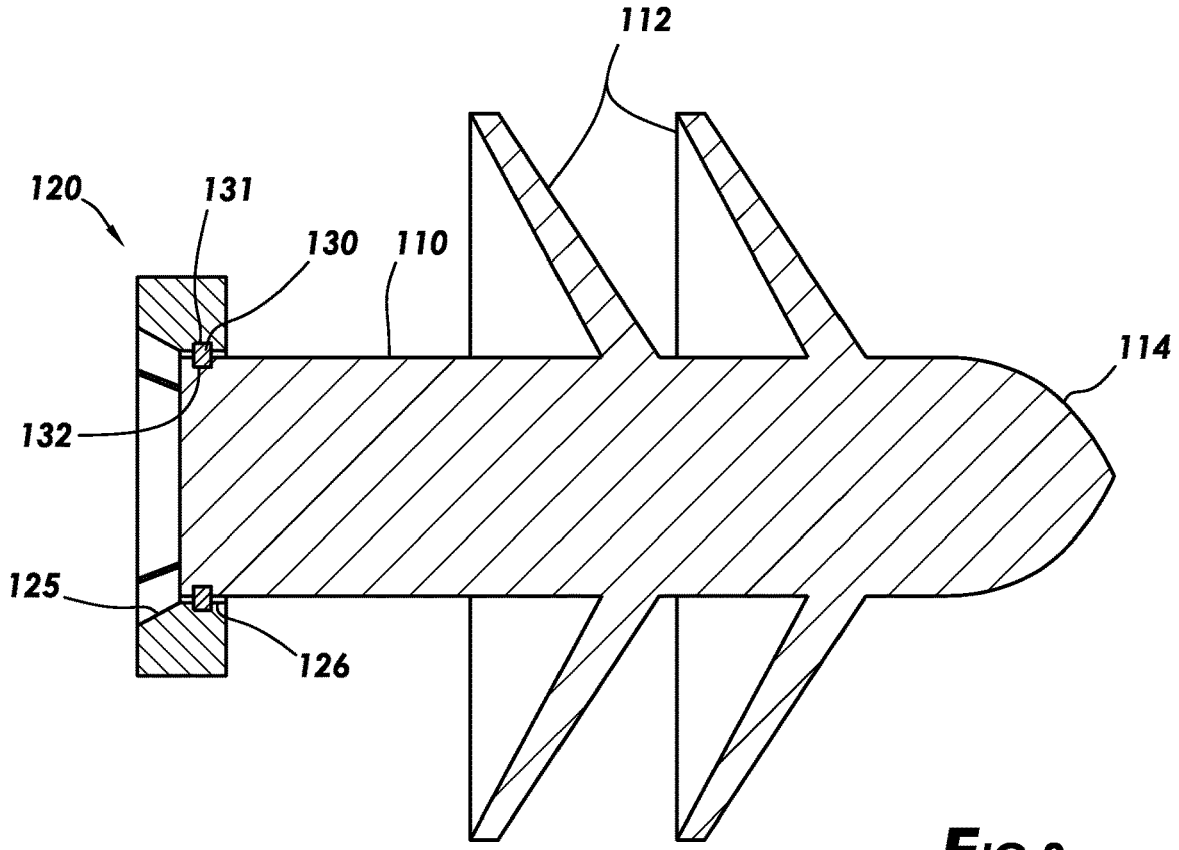
FIG. 2 is a longitudinal, cross-sectional view of the wellbore dart of FIG. 1.

FIG. 2 is a cross-sectional view of the dart 100. As can be seen, the tool activator 120 is releasably connected to the body 110 by a frangible device 130. The tool activator 120 is releasably connected to a second end of the body 110 opposite of the nose 114. The frangible device 130 can be any device that is capable of withstanding a predetermined amount of force and capable of releasing at a force above the predetermined amount of force. The frangible device 130 can be, for example, a shear pin, a shear screw, a shear ring, a load ring, a lock ring, a pin, or a lug. There can also be more than one frangible device 130 that connects the tool activator 120 to the body 110. The frangible device 130 or multiple frangible devices can be selected based on the force rating of the frangible device, the total number of frangible devices used, and the predetermined amount of force needed to release or shear the frangible device. For example, if the total force required to break or shear the frangible device is 15,000 pounds force ($lb_f$) and each frangible device has a rating of 5,000 $lb_f$, then a total of three frangible devices may be used.

The frangible device 130 spans from a recess 131 located within an inner diameter of a section of the tool activator 120 to a recess 132 located within an outside of the body 110. According to any of the embodiments, at least one frangible device 130 releasably connects every section 121, 122, 123, and 124 to the body 110. In this manner the dart 100 and each section 121/122/123/124 of the tool activator 120 has structural integrity until the pressure in the tubing string is sufficient to shear the frangible devices 130. According to these embodiments, there would be a total of four frangible devices 130, four recesses 131 (one for each of the four sections 121/122/123/124), and four recesses 132 on the body 110 that correspond to the recesses 131 on the sections 121/122/123/124. It is to be understood that if the tool activator 120 includes more than four sections, then the total number of frangible devices 130 included can be greater than four.

As can be seen in FIG. 2, the tool activator 120 includes an inner diameter and an outer diameter. The I.D. can include an angled surface 125 that partially extends from a top end of the tool activator 120 towards a bottom end. The I.D. can also have a straight surface 126 that extends from where the angled surface 125 ends to the bottom end. According to any of the embodiments, the recesses 131 for housing the frangible devices 130 are located within the straight surface 126. These embodiments can be useful when the top of the body 110 terminates at the angled surface 125/straight surface 126 junction. This location of frangible devices can prevent premature shearing of the frangible devices.

Figure 3:
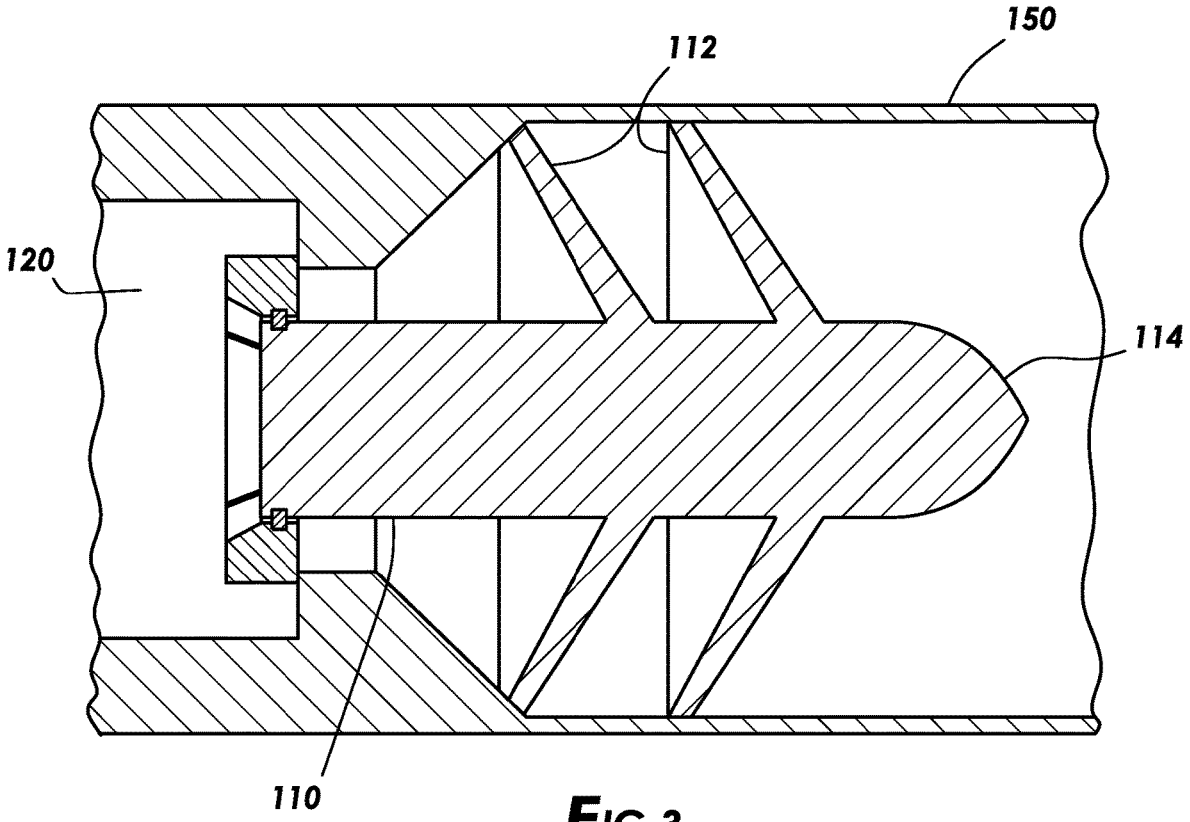
FIG. 3 is a longitudinal, cross-sectional view of the wellbore dart after engaging with a downhole tool.

The methods include introducing the dart 100 into a wellbore. The wellbore can include a tubing string and a downhole tool located within the tubing string. As shown in FIG. 3, the tool activator 120 can be configured to engage with a downhole tool 150. The methods can include causing or allowing the tool activator 120 to activate the downhole tool 150. The tool activator 120 can activate the downhole tool to cause an action to occur. Examples of the action include, but are not limited to, shifting of a sleeve of the downhole tool, rotating a sleeve of the downhole tool, or shutting off fluid flow through the downhole tool. The tool activator 120 can cause a variety of different actions to occur depending on the exact downhole tool that the tool activator 120 activates. The tool activator 120 is releasably connected to the body 110 during activation of the downhole tool 150.

Figure 4:
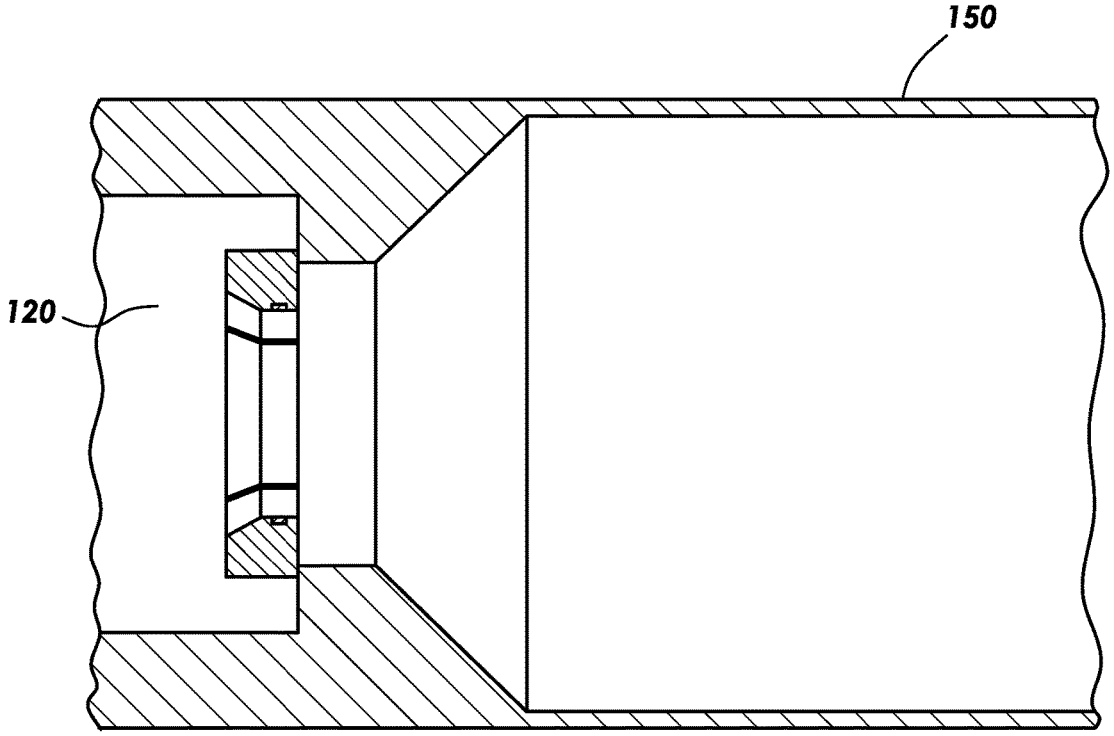
FIG. 4 is a longitudinal, cross-sectional view of the wellbore dart of FIG. 3 showing separation of the tool activator from the body of the dart.

The methods can include releasing the tool activator 120 from connection with the body 110. The step of releasing can include applying a pressure to the dart 100. By way of example, after the tool activator 120 has activated the downhole tool 150, a force can be applied to the dart 100 that shears the frangible devices 130; thus, separating the tool activator 120 from the body 110. As shown in FIG. 4, the tool activator 120 remains engaged with the downhole tool 150 after shearing, while the body 110, the nose 114, and the wipers 112 can travel through the downhole tool 150, thereby enabling fluid flow through the downhole tool 150. The body 110, the nose 114, and the wipers 112 can be retained by the downhole tool 150 or retained in a separate retainer after shearing and traveling downstream of the tool activator 120.

Figure 5A:
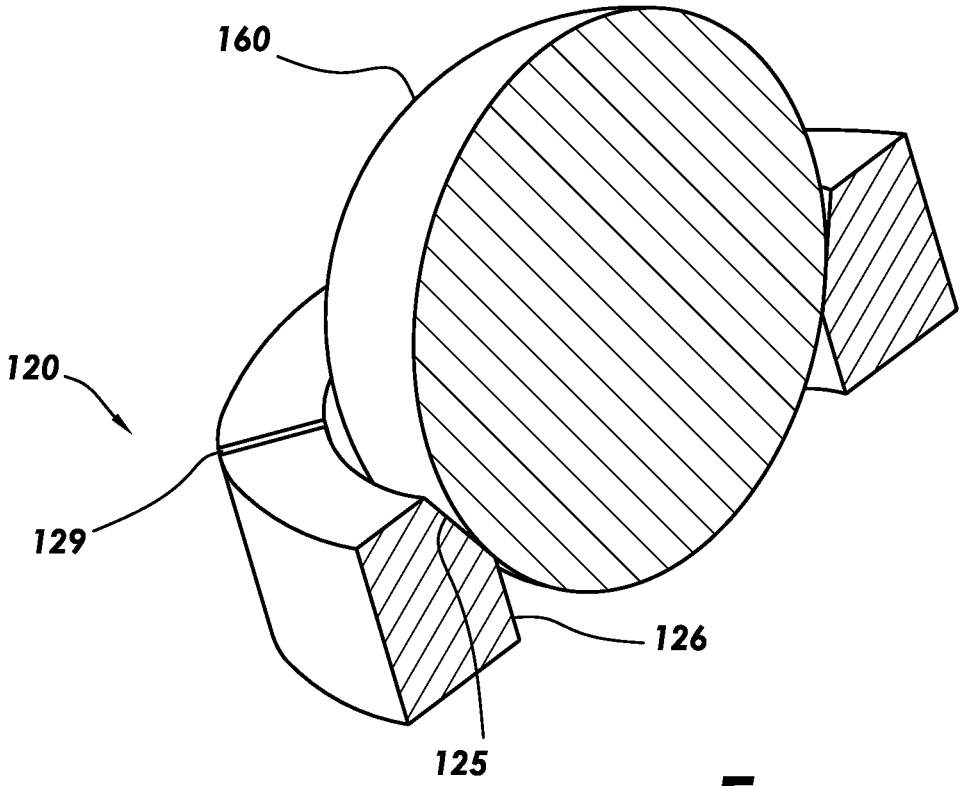
FIG. 5A is a vertical, cross-sectional view of a tool activator of the wellbore dart showing a ball landing on the tool activator.

After the tool activator 120 has been released from connection with the body 110, the methods can include introducing a device into the wellbore. The device can be, without limitation, another dart, a plug, or a ball. The device can have an O.D. that is greater than the I.D. of the tool activator 120. Turning to FIG. 5A, the device is depicted as a ball 160 having an O.D. greater than the I.D. of the tool activator 120.

Figure 5B:
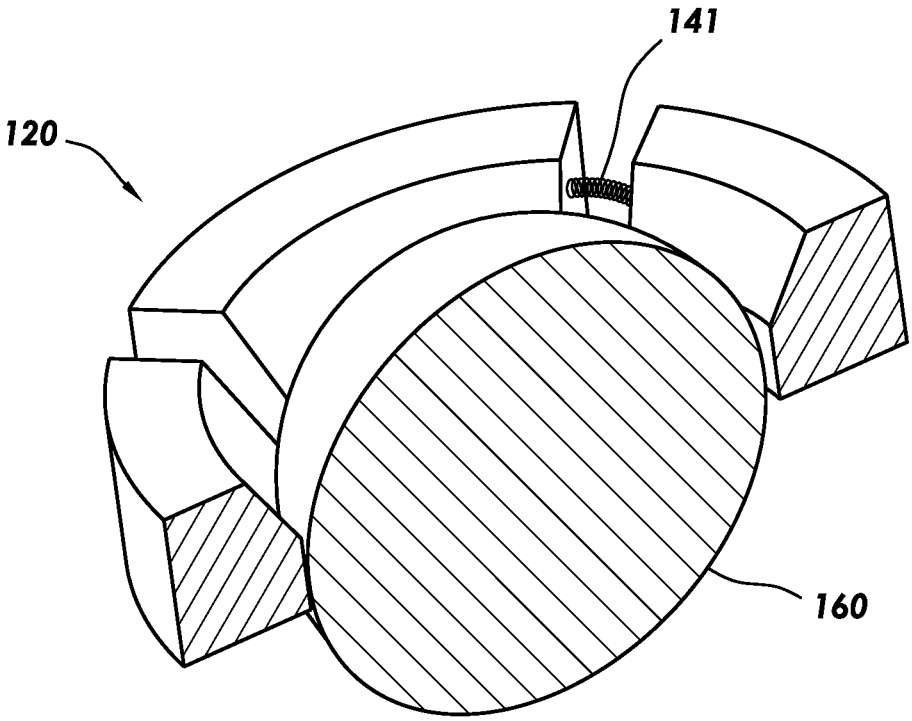
FIG. 5B is a vertical, cross-sectional view of the tool activator of FIG. 5A showing a ball passing through the tool activator.

The sections 121/122/123/124 of the tool activator 120 are movable radially away from each other into an expanded position when a force is applied to the I.D. of the tool activator 120. As can be seen in FIGS. 5A and 5B, the ball 160 can land onto the tool activator 120. Angled surfaces 125 of the sections 121/122/123/124 can guide or force the ball 160 into the center of the tool activator 120. Continued application of a downward force on the ball 160, for example via fluid pressure within the tubing string, causes the ball 160 to exert an outward force on the sections 121/122/123/124. The greater or steeper the angle of the angled surfaces 125, the more uniform spread as well as increased spread of the sections 121/122/123/124 that can be achieved. This outward force causes the sections 121/122/123/124 to expand radially away from each other into an expanded position, for example, as shown in FIG. 5B. When the sections 121/122/123/124 have expanded a sufficient distance away from center, the ball 160 has enough clearance to pass through the tool activator 120. Accordingly, causing the device to pass through the tool activator can include applying a downward pressure to the device, wherein the downward pressure forces the sections 121/122/123/124 to radially move away from each other into the expanded position.

According to any of the embodiments, the tool activator 120 includes at least three sections 121/122/123. In this manner, radial expansion away from each other can be more easily achieved. The force that is applied to the sections 121/122/123/124 may need to be in more than two directions. If the tool activator 120 includes only two sections, then a sufficient radial expansion away from each other may not occur to allow the device to pass through the tool activator 120.

Figure 6A:
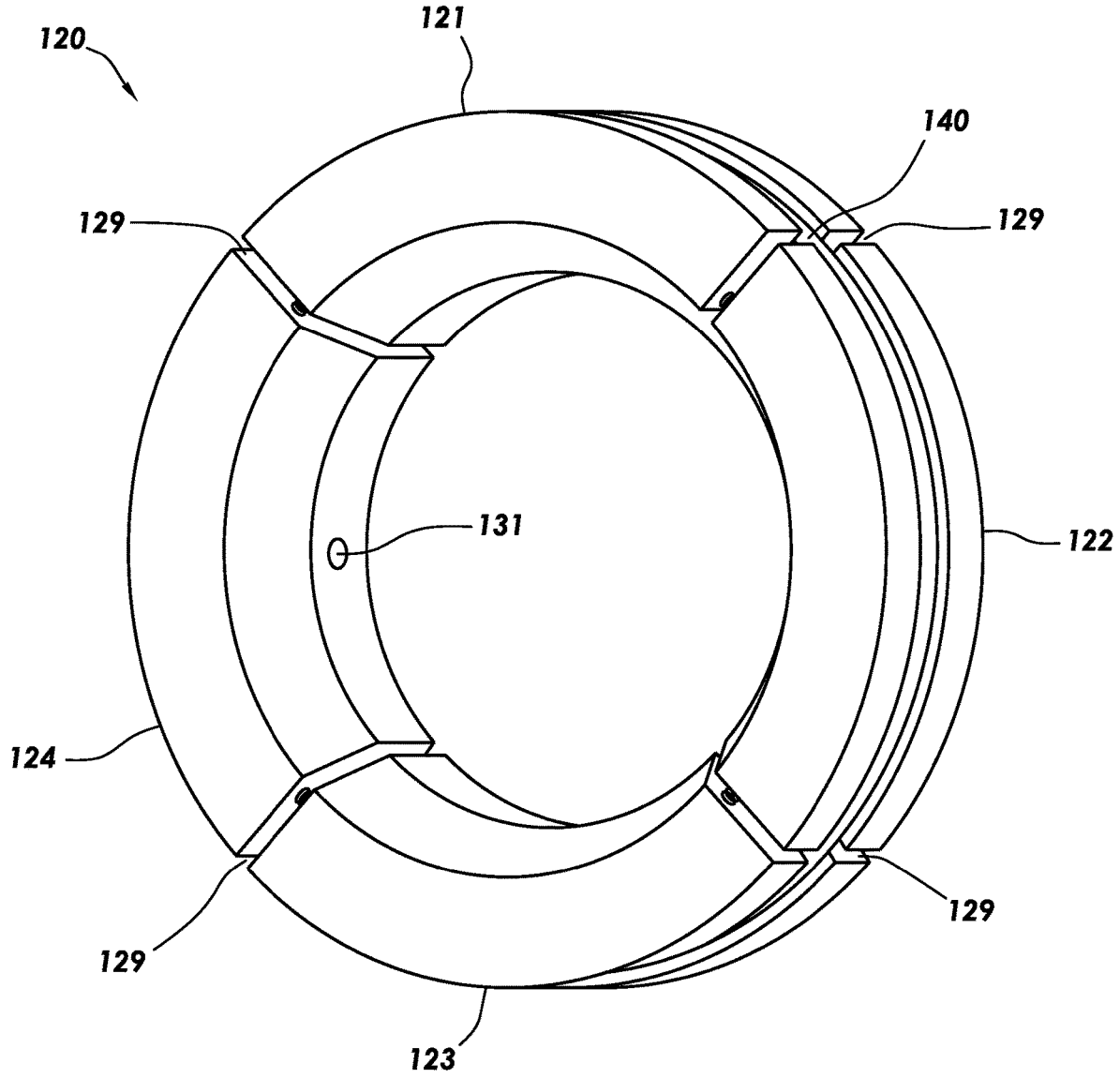
FIG. 6A is a perspective view of a tool activator of the wellbore dart with a band as a retracting device.

FIG. 6A shows a perspective view of the tool activator 120. As can be seen, a demarcation line 129 can delineate the sections 121/122/123/124. According to any of the embodiments, the tool activator 120 can include discreet sections 121/122/123/124 that are made by forming the tool activator 120 as a single unit and then cutting the tool activator into the desired number of sections. Alternatively, each section can be formed independently and then assembled into a completed tool activator that is then releasably connected to the body 110. According to any of the other embodiments, the tool activator 120 can be formed as a single unit that includes three or more score lines, wherein the total number of score lines equals the total number of sections. The score lines provide a weak point whereby an applied force can break the tool activator 120 into the desired number of sections. If the tool activator 120 includes score lines, then only two frangible devices 130 that are located opposite each other may be needed because structural integrity is maintained due to the tool activator 120 being formed as a single unit.

The methods can include allowing the sections 121/122/123/124 to move radially towards each other into a retracted position after the device (e.g., the ball 160) has passed through the tool activator 120. The tool activator 120 can also include a retracting device. The retracting device can be configured to cause the sections 121/122/123/124 to move into the retracted position after expansion.

FIG. 6A depicts a band 140 as the retracting device. The band 140 can be positioned around the outside of the tool activator 120 and surround all of the sections 121/122/123/124. The band 140 can have a height that is within 20% to 100% of the height of the sections 121/122/123/124. The band 140 can be made from a stretchable material that then returns to its pre-stretched state after the device passes through the tool activator 120. Materials such as natural latex rubber and expanded neoprene are suitable for this purpose. Other suitable materials for the band 140 include, but are not limited to, knitted compression cottons, polyesters, or other fibers, and thermal plastics that are stretchable. A circumferential coil spring could also be used for the band. In this manner, the band 140 can expand with the sections 121/122/123/124 without breaking into the expanded position during passage of the device and then move the sections 121/122/123/124 radially towards each other into the retracted position.

Figure 6C:
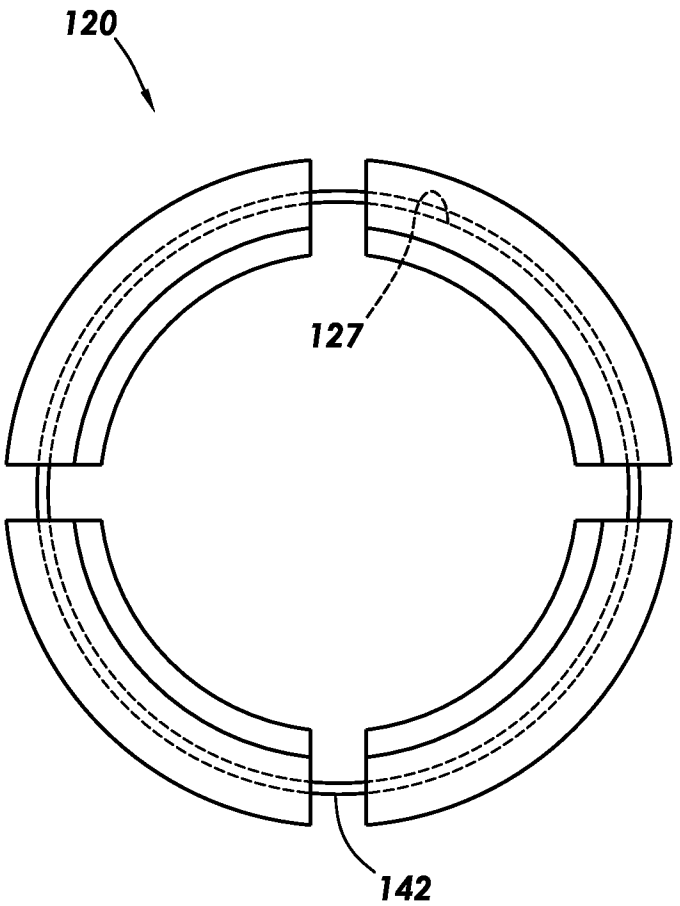
FIG. 6C is a horizontal, cross-sectional view of a tool activator of the wellbore dart with a ring as a retracting device.
Figure 6B:
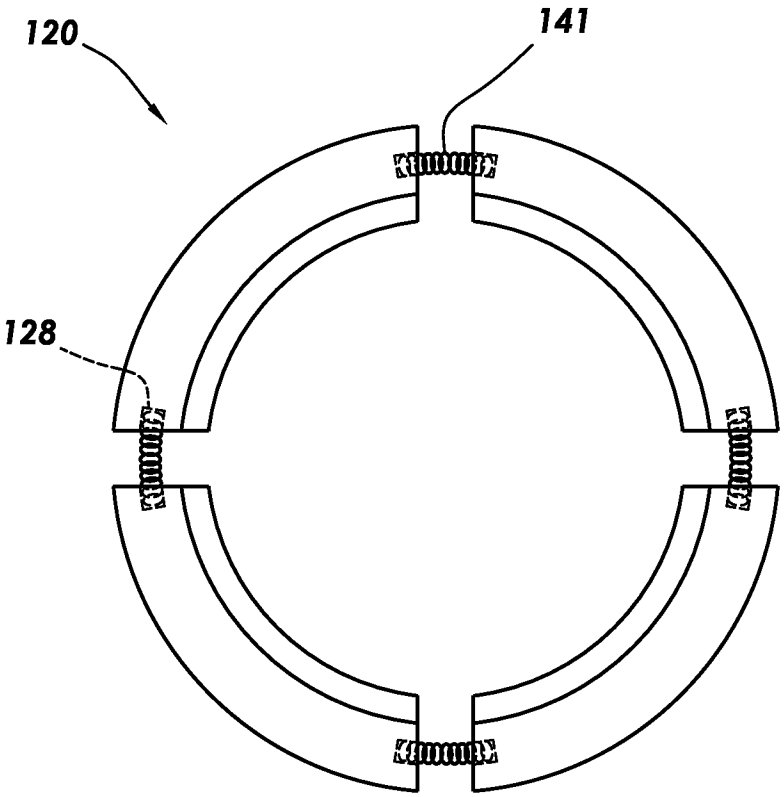
FIG. 6B is a horizontal, cross-sectional view of a tool activator of the wellbore dart with springs as a retracting device.

FIG. 6B is a horizontal, cross-sectional view of the tool activator 120 in the expanded position and depicts a spring 141 as the retracting device. The tool activator 120 can include at least a first spring 141 that connects the first section 121 to the second section 122, a second spring that connects the second section 122 to the third section 123, a third spring that connects the third section 123 to the fourth section 124, and a fourth spring that connects the fourth section 124 to the first section 121. In other words, at least one spring 141 is located at each demarcation line 129. There can be more than one spring 141 located at each demarcation line 129. Both ends of each of the sections 121/122/123/124 can include a receiver 128 that houses an end of the spring 141. The ends of the spring 141 can be permanently attached to the sections 121/122/123/124, for example with a glue, resin, hardened plastic, or other compounds. Preferably, the receivers 128 are located within the straight surface 126 area of the sections 121/122/123/124. In this manner, the springs 141 are capable to stretching with the sections 121/122/123/124 into the expanded position without breaking or detaching from the sections 121/122/123/124 and then moving the sections 121/122/123/124 back towards each other into the retracted position.

FIG. 6C is a horizontal, cross-sectional view of the tool activator 120 in the expanded position and depicts a ring 142, such as an O-ring, located circumferentially within the sections 121/122/123/124. A middle portion of the sections 121/122/123/124 can include a receiving groove 127 that houses the ring 142. The ring 142 can be made from a stretchable material, for example, those materials disclosed above for the band. Preferably, the receiving groove 127 is located within the straight surface 126 area of the sections 121/122/123/124. In this manner, the ring 142 is capable to stretching with the sections 121/122/123/124 into the expanded position without breaking and then moving the sections 121/122/123/124 back towards each other into the retracted position.

According to certain other embodiments, the tool activator 120 does not include a retracting device. An adhesive can be applied to each demarcation line 129 to temporarily hold the sections 121/122/123/124 together. The adhesive can be a glue or resin, for example. The sections 121/122/123/124 can separate from one another when a force from the device (e.g., the ball 160) is applied to the tool activator 120 and this force causes the adhesive to lose its bonding ability. The sections 121/122/123/124 can also be temporarily held together by score lines or a band, for example a metal band, located around the outside of the sections 121/122/123/124. When the force from the device is applied to the tool activator 120, the sections 121/122/123/124 can separate from each other by breaking into sections at the score lines or the band breaking into two or more pieces. Frangible devices can also be used to temporarily hold the sections together. The frangible devices can be positioned on the tool activator 120 as discussed above regarding the springs 141. When the force from the device is applied to the tool activator 120, the sections 121/122/123/124 can separate from each other by shearing of the frangible devices.

For the embodiments in which a retracting device is not used, a retainer can be included in the tubing string or the downhole tool 150 located adjacent to the tool activator 120. Because the sections 121/122/123/124 are not held together by a retracting device, the sections are susceptible to falling or flowing into the downhole tool and creating an obstruction. The retainer can be any component that prevents the sections 121/122/123/124 from flowing downstream within the downhole tool 150 after separating from each other. The retainer can be, without limitation, a sleeve or a pocket that retains the separated sections 121/122/123/124 at their location. An elastomeric sleeve can be used to contract and move the sections 121/122/123/124 back towards each other into the retracted position after the device passes through the tool activator 120.

Figure 7:
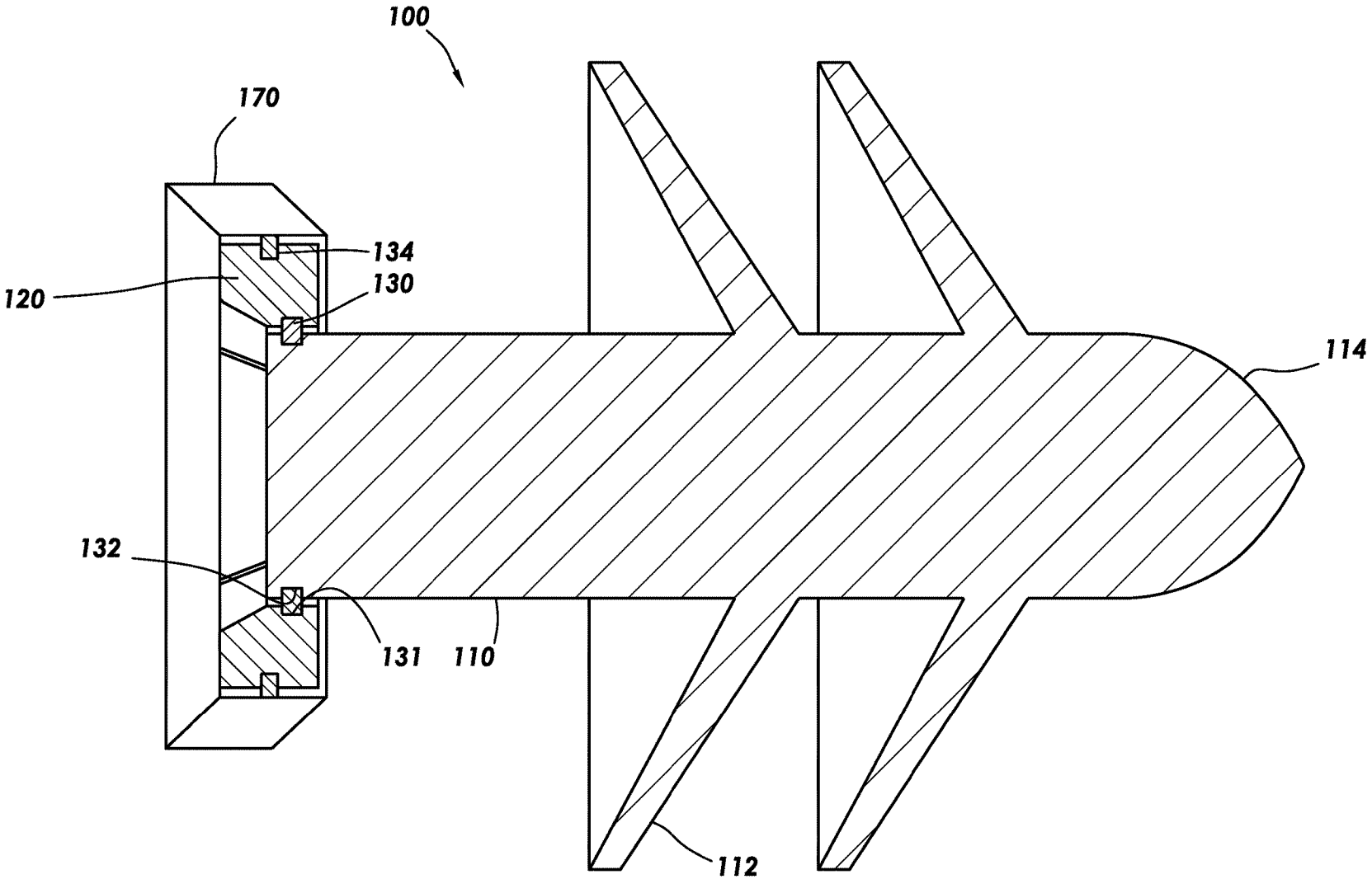
FIG. 7 is a longitudinal, cross-sectional view of the wellbore dart according to certain other embodiments.

Turning to FIG. 7, the dart 100 can include a second tool activator 170. The second tool activator 170 can be positioned around the outside of the tool activator 120. The second tool activator 170 can have a different shape, for example a rhombus shape, from the tool activator 120, which has a ring shape. The second tool activator 170 can be removably attached to the tool activator 120 by two or more frangible devices 134. In practice, the second tool activator 170 can activate the downhole tool 150 to perform a first function, and then the tool activator 120 can be detached from the second tool activator 170 via shearing of the frangible devices 134. After shearing, the second tool activator 170 can remain in place while the tool activator 120, body 110, and the other components of the dart 100 can move further downstream within the downhole tool 150. The tool activator 120 can then activate the downhole tool 150 to perform a second function. After the second function has been performed, the tool activator 120 can be detached from the body 110 via shearing of the frangible devices 130.

An embodiment of the present disclosure is a wellbore dart comprising: a body; and a tool activator releasably connected to the body by a frangible device, wherein the tool activator comprises: a first section; a second section; a third section, wherein the first, second, and third sections are movable radially away from each other into an expanded position when a force is applied to an inner diameter of the tool activator; and a retracting device, wherein the retracting device is configured to move the first, second, and third sections radially towards each other from the expanded position into a retracted position when the force is removed from the inner diameter of the tool activator. Optionally, the wellbore dart further comprises wherein the tool activator is made from metals, metal alloys, or hardened plastics or composites. Optionally, the wellbore dart further comprises wherein each of the first, second, and third sections comprise at least one frangible device. Optionally, the wellbore dart further comprises wherein the frangible device is selected from the group consisting of a shear pin, a shear screw, a shear ring, a load ring, a lock ring, a pin, a lug, or combinations thereof. Optionally, the wellbore dart further comprises wherein the tool activator further comprises one or more wipers located circumferentially around an outside of the body. Optionally, the wellbore dart further comprises wherein the inner diameter of the tool activator comprises an angled surface that partially extends from a top end of the tool activator towards a bottom end, and wherein the inner diameter of the tool activator further comprises a straight surface that extends from a bottom edge of the angled surface to the bottom end of the tool activator. Optionally, the wellbore dart further comprises wherein the force is applied to the inner diameter of the tool activator via a device, wherein the device is selected from another dart, a plug, or a ball, and wherein the device has an outer diameter that is greater than the inner diameter of the tool activator. Optionally, the wellbore dart further comprises wherein the tool activator is configured to allow the device to pass through the tool activator via a sufficient radial expansion of the first, second, and third sections. Optionally, the wellbore dart further comprises wherein the retracting device is a band positioned circumferentially around the outside of the first, second, and third sections. Optionally, the wellbore dart further comprises wherein the band is made from a stretchable material that returns to a pre-stretched state after the force is removed. Optionally, the wellbore dart further comprises wherein the retracting device comprises at least three springs that correspond to the first, second, and third sections, wherein at least one of the at least three springs is located between two of the sections. Optionally, the wellbore dart further comprises wherein each of the first, second, and third sections comprises a receiver that houses an end of the at least three springs. Optionally, the wellbore dart further comprises wherein the retracting device is a ring, wherein a middle portion of the first, second, and third sections comprises a receiving groove that houses the ring, and wherein the ring is made from a stretchable material that returns to a pre-stretched state after the force is removed. Optionally, the wellbore dart further comprises a second tool activator, wherein the second tool activator is positioned around the outside of the tool activator.

Another embodiment of the present disclosure is a wellbore dart comprising: a body; and a tool activator releasably connected to the body by a frangible device, wherein the tool activator comprises: a first section; a second section; and a third section, wherein the first, second, and third sections are movable radially away from each other into an expanded position when a force is applied to an inner diameter of the tool activator. Optionally, the wellbore dart further comprises a retainer, wherein the retainer prevents the first, second, and third sections from flowing downstream within a downhole tool after separating from each other via the force applied to the inner diameter of the tool activator. Optionally, the wellbore dart further comprises wherein the retainer is selected from a sleeve or a pocket.

Another embodiment of the present disclosure is a method of activating a downhole tool comprising: introducing a dart into a wellbore, wherein the dart comprises: a body; and a tool activator comprising a first section, a second section, and a third section, wherein the tool activator is releasably connected to the body by a frangible device; causing or allowing the tool activator to activate the downhole tool; releasing the tool activator from connection with the body; introducing a device into the wellbore, wherein the device has an outer diameter that is greater than an inner diameter of the tool activator; causing the device to pass through the tool activator, wherein the device causes the first, second, and third sections to move radially away from each other into an expanded position as the device passes through the tool activator; and allowing the first, second, and third sections to move radially towards each other into a retracted position after the device has passed through the tool activator. Optionally, the method further comprises wherein the body releases from the tool activator after activation of the downhole tool, and wherein after releasing, the body moves downstream within the downhole tool. Optionally, the method further comprises wherein the step of releasing comprises applying a pressure to the dart.

Therefore, the various embodiments are well adapted to attain the ends and advantages mentioned as well as those that are inherent therein. The particular embodiments disclosed above are illustrative only, as the various embodiments may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more sections, wipers, springs, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A wellbore dart comprising:

a body; and a tool activator releasably connected to the body by a frangible device, wherein the tool activator comprises:

a first section;

a second section;

a third section, wherein the first, second, and third sections are movable radially away from each other into an expanded position when a force is applied to an inner diameter of the tool activator; and a retracting device, wherein the retracting device is configured to move the first, second, and third sections radially towards each other from the expanded position into a retracted position when the force is removed from the inner diameter of the tool activator.

2. The wellbore dart according to claim 1, wherein the tool activator is made from metals, metal alloys, or hardened plastics or composites.

3. The wellbore dart according to claim 1, wherein each of the first, second, and third sections comprise at least one frangible device.

4. The wellbore dart according to claim 1, wherein the frangible device is selected from the group consisting of a shear pin, a shear screw, a shear ring, a load ring, a lock ring, a pin, a lug, and combinations thereof.

5. The wellbore dart according to claim 1, wherein the tool activator further comprises one or more wipers located circumferentially around an outside of the body.

6. The wellbore dart according to claim 1, wherein the inner diameter of the tool activator comprises an angled surface that partially extends from a top end of the tool activator towards a bottom end, and wherein the inner diameter of the tool activator further comprises a straight surface that extends from a bottom edge of the angled surface to the bottom end of the tool activator.

7. The wellbore dart according to claim 1, wherein the force is applied to the inner diameter of the tool activator via a device, wherein the device is selected from another dart, a plug, or a ball, and wherein the device has an outer diameter that is greater than the inner diameter of the tool activator.

8. The wellbore dart according to claim 7, wherein the tool activator is configured to allow the device to pass through the tool activator via a sufficient radial expansion of the first, second, and third sections.

9. The wellbore dart according to claim 1, wherein the retracting device is a band positioned circumferentially around the outside of the first, second, and third sections.

10. The wellbore dart according to claim 9, wherein the band is made from a stretchable material that returns to a pre-stretched state after the force is removed.

11. The wellbore dart according to claim 1, wherein the retracting device comprises at least three springs that correspond to the first, second, and third sections, wherein at least one of the at least three springs is located between two of the sections.

12. The wellbore dart according to claim 11, wherein each of the first, second, and third sections comprises a receiver that houses an end of the at least three springs.

13. The wellbore dart according to claim 1, wherein the retracting device is a ring, wherein a middle portion of the first, second, and third sections comprises a receiving groove that houses the ring, and wherein the ring is made from a stretchable material that returns to a pre-stretched state after the force is removed.

14. The wellbore dart according to claim 1, further comprising a second tool activator, wherein the second tool activator is positioned around the outside of the tool activator.

15. A wellbore dart comprising:

a body; and a tool activator releasably connected to the body by a frangible device, wherein the tool activator comprises:

a first section;

a second section; and a third section, wherein the first, second, and third sections are movable radially away from each other into an expanded position when a force is applied to an inner diameter of the tool activator.

16. The wellbore dart according to claim 15, further comprising a retainer, wherein the retainer prevents the first, second, and third sections from flowing downstream within a downhole tool after separating from each other via the force applied to the inner diameter of the tool activator.

17. The wellbore dart according to claim 16, wherein the retainer is selected from a sleeve or a pocket.

18. A method of activating a downhole tool comprising:

introducing a dart into a wellbore, wherein the dart comprises:

a body; and a tool activator comprising a first section, a second section, and a third section, wherein the tool activator is releasably connected to the body by a frangible device;

causing or allowing the tool activator to activate the downhole tool;

releasing the tool activator from connection with the body;

introducing a device into the wellbore, wherein the device has an outer diameter that is greater than an inner diameter of the tool activator;

causing the device to pass through the tool activator, wherein the device causes the first, second, and third sections to move radially away from each other into an expanded position as the device passes through the tool activator; and allowing the first, second, and third sections to move radially towards each other into a retracted position after the device has passed through the tool activator.

19. The method according to claim 18, wherein the body releases from the tool activator after activation of the downhole tool, and wherein after releasing, the body moves downstream within the downhole tool.

20. The method according to claim 18, wherein the step of releasing comprises applying a pressure to the dart.

* * * * *